US005174236A

United States Patent [19]

Moody

[11] Patent Number: 5,174,236

[45] Date of Patent: Dec. 29, 1992

[54] SUBMARINE TORPEDO TUBE MOTION WEAPON RESTRAINER

[75] Inventor: Paul E. Moody, Barrington, R.I.

[73] Assignee: The United States of America as represented by the Secretary of the Navy, Washington, D.C.

[21] Appl. No.: 907,760

[22] Filed: Jun. 29, 1992

[51] Int. Cl.[5] ..... B63B 8/32

[52] U.S. Cl. ..... 114/238; 114/318; 114/319; 89/1.810

[58] Field of Search ..... 114/319, 318, 316, 313, 114/322, 337, 330–332, 338, 238, 20 R; 89/1.808–1.810, 1.801, 1.806, 1.812, 1.816, 1.817, 5

[56] References Cited

U.S. PATENT DOCUMENTS

| | | | |
|---|---|---|---|
| 1,370,467 | 3/1921 | McMahon | 114/318 |
| 3,106,905 | 10/1963 | Gonden | 114/238 |
| 3,754,726 | 8/1973 | Rusbach | 89/1.806 |
| 4,191,087 | 3/1980 | Campbell | 89/1.806 |
| 5,025,744 | 6/1991 | Moody | 114/238 |

*Primary Examiner*—Joseph F. Peters, Jr.

*Assistant Examiner*—Clifford T. Bartz

*Attorney, Agent, or Firm*—Michael J. McGowan; Prithvi C. Lall; Michael F. Oglo

[57] ABSTRACT

A positioning assembly for a torpedo having a projection thereon including a support mounted on the torpedo tube adjacent the projection, and a control member movable on the support transversely of the torpedo tube. The control member has a control surface with a series of abutment surfaces for the projection to limit motion of the torpedo within the tube. A first transverse abutment surface limits movement of the torpedo towards the muzzle end of the tube during loading, and a second transverse abutment surface cooperates with a portion of the first abutment surface to limit movement of the torpedo in either direction axially in the tube. The control member is movable on the support to (i) a first position wherein the projection is engageable with only the first abutment surface, (ii) a second position wherein the projection is disposed between the first and second abutment surfaces, and (iii) a third position wherein the projection is free from the first abutment surface so that the torpedo is movable towards the muzzle end of the tube.

15 Claims, 5 Drawing Sheets (LOAD POSITION)

(LOCK POSITION)

(FIRE POSITION- PRIOR TO WEAPON MOTION)

SUBMARINE TORPEDO TUBE MOTION WEAPON RESTRAINER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to torpedo launching apparatus, and, more particularly, to a torpedo tube assembly for controlling the motion of the torpedo therewithin.

(2) Description of the Prior Art

As is well known, submarines are frequently equipped with torpedo launching apparatus which includes a torpedo tube in which the torpedo is placed. Generally, these torpedo tubes will have a closure at both breech and muzzle ends of the torpedo tube, and the closure at the inner or breech end of the torpedo tube is opened to allow insertion of the torpedo thereinto. When firing of the torpedo is intended, the outer or muzzle door and shutter are opened to permit the torpedo to exit. When the ejection system door is opened, a flow path within the ship permits flow from the torpedo tube door to the ejection system door. The water flow into the torpedo tube can displace the torpedo rearwardly within the tube in the event that such motion is not restricted. The weapon must also be restricted from rotating within the tube, once its propulsion system is started.

To provide clearance about the torpedo, the tube is of larger inner diameter so as to provide radial spacing about the torpedo, and the torpedo is supported between a multiplicity (usually four) of axially extending lands carried by the tube.

To control the motion of the torpedo within the torpedo tube, it is desirable to provide a pair of axially spaced guide studs project from the circumference of the torpedo, and these travel in a channel formed in a guide land within the tube. This precludes relative rotation of the torpedo within the tube, and guides the torpedo in its axial movement. In some torpedo tube assemblies, a stop bolt mechanism is employed to grip one of the guide studs prior to firing so that the torpedo is held in a fixed predetermined position within the torpedo tube until fired. Unfortunately, such retaining mechanisms have been fairly complex in construction and in operation, and are not always effective when there is a large pressure differential along the length of the torpedo tube.

SUMMARY OF THE INVENTION

Accordingly, it is an object of the present invention to provide a novel torpedo tube assembly including a positioning assembly providing substantial control over axial movement of the torpedo within the torpedo tube and which is relatively simple in structure and operation.

It is also an object to provide such a positioning assembly in which rotational motion of the torpedo within the torpedo tube may also be restricted.

Another object is to provide such a positioning assembly in which may be readily incorporated in existing torpedo tubes, and which is reliable and long lived in operation.

It has now been found that the foregoing and related objects may be readily attained in a positioning assembly used in combination with a torpedo tube having breech and muzzle ends and a torpedo having at least one outwardly extending projection intermediate its length for guidance thereof during axial movement along the tube. The assembly includes a support mounted on the torpedo tube adjacent the projection, and a control member movable on the support transversely of the torpedo tube and having a control surface with a series of abutments for the projection on the torpedo to thereby limit motion of the torpedo within the tube. The control surface is configured to provide a first transverse abutment surface to limit movement of the torpedo towards the muzzle end of the tube during loading thereinto, and a second transverse abutment surface axially spaced from and cooperating with a portion of the first abutment surface to limit movement of the torpedo in either direction axially in the tube.

The control member is movable on the support to (i) a first position wherein the projection is engageable with only the first abutment surface, (ii) a second position wherein the projection is disposed between the first and second abutment surfaces, and (iii) a third position wherein the projection is free from the first abutment surface so that the torpedo is movable towards the muzzle end of the tube. The assembly also includes drive means for moving the control member to the several positions.

Preferably, the control member includes a third, axially disposed abutment surface along the side of the control member spaced from the first abutment surface and adjacent the second abutment surface, and the first abutment surface terminates in spaced relationship from this side to permit the projection to move outwardly of the control member towards the muzzle end and beyond in the third position. The third abutment surface limits motion of the control member into a fourth position wherein it is displaced from the axial path of travel of the projection by abutment against the projection until the projection has moved towards the muzzle end of the tube and beyond the third abutment surface.

Desirably, the positioning assembly includes axially disposed abutment surfaces to limit rotational movement of the torpedo in either direction in the tube while the projection is disposed therebetween.

The drive means includes a cylinder and a piston rod extending outwardly therefrom and operatively coupled to the control member, with the outwardly extending portion of the piston rod being movable between predetermined positions to effect the desired motion of the control member. The cylinder and piston rod are oriented transversely of the tube, and the drive means moves the control member transversely of the torpedo tube.

In its preferred form, the cylinder has a chamber with a smaller diameter portion adjacent the end through which the piston rod extends and a larger diameter portion adjacent the other end, and this provides a shoulder therebetween. The piston rod has a fixed piston thereon in sealing engagement with the wall defining the smaller diameter portion, and there are included (i) a movable piston in the larger diameter portion in sealing engagement with the wall thereof, (ii) resiliently compressible biasing means biasing the movable piston against the shoulder, and (iii) ports in the cylinder into the chamber adjacent each end thereof and in the smaller diameter portion adjacent the shoulder. As a result, (a) fluid under pressure introduced through the ports in the end of the larger diameter portion and adjacent the shoulder will move the piston rod to a fully outwardly extended position, (b) fluid under pressure introduced through the ports at each end of the chamber will move the piston rod to an intermediate position in which the inner end thereof abuts the movable piston, and (c) fluid under pressure supplied only to the port adjacent the end of the smaller diameter portion will move the piston rod to a retracted position in which it moves the movable piston away from the shoulder against the biasing means and towards the other end of the cylinder.

BRIEF DESCRIPTION OF THE ATTACHED DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT(S)

Figure 1:
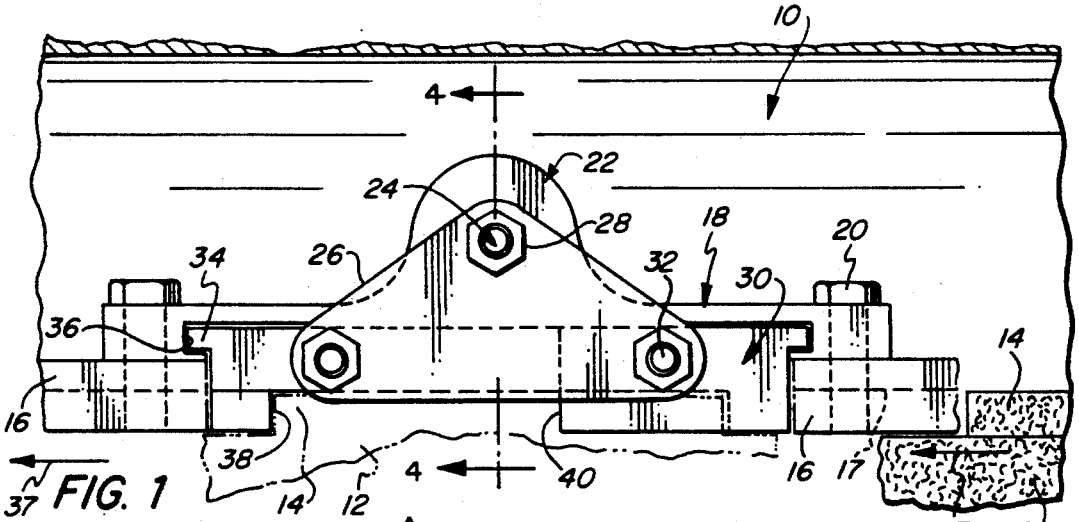
FIG. 1 is a fragmentary athwartships view of a torpedo tube incorporating the positioning assembly of the present invention, and with a torpedo fragmentarily illustrated in phantom line.
Figure 4:
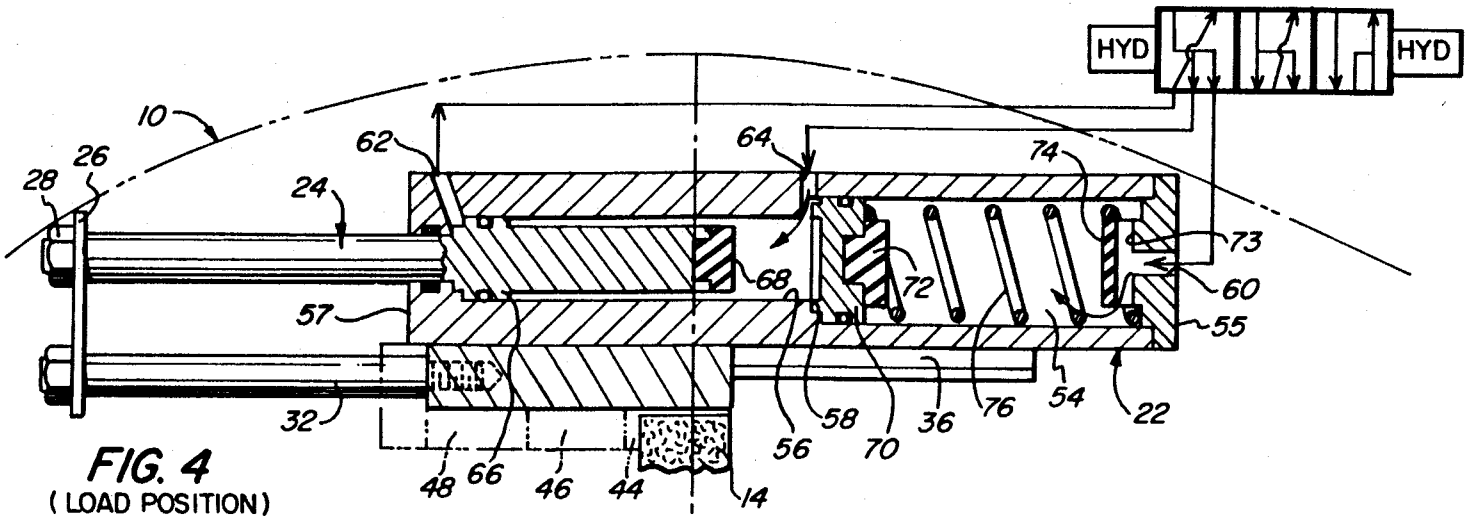
FIG. 4 is a fragmentary sectional view of the positioning assembly along the line 4—4 of FIG. 1 showing the elements in a first position for loading the torpedo into the tube and schematically showing the hydraulic control valve for the drive cylinder.

Turning first to FIGS. 1 and 4, therein are fragmentarily illustrated a torpedo tube generally designated by the numeral 10, and a torpedo fragmentarily illustrated in phantom line and generally designated by the numeral 12 with a pair of axially spaced guide studs 14 projecting therefrom (only the forward one is fragmentarily illustrated). The torpedo tube 10 has four axially extending lands 16 spaced about its inner periphery, only the top one of which is fragmentarily illustrated and this land has a channel 17 therein in which the guide stud 14 is slidable. The direction of movement of the torpedo 12 from the breech end to the muzzle end of the torpedo tube 12 is shown by the arrows 37. Mounted on the upper land 16 for positioning the torpedo 12 in the torpedo tube 10 is a positioning assembly embodying the present invention.

The assembly comprises a support member generally designated by the numeral 18 which is secured to the top land 16 by the bolts 20 and a hydraulic cylinder generally designated by the numeral 22 mounted thereon. Slidably supported within the cylinder 22 is a piston rod generally designated by the numeral 24, and at the outer end of the piston rod 24 is a connector plate 26 which is secured thereto by the nut 28. Slidably supported within the support member 18 is a slide member generally designated by the numeral 30 which has a pair of threaded rods 32 extending therefrom and through the connector plate 26. The slide member 30 has flanges 34 extending along the sides thereof which seat in channels 36 formed in the support member 18 so that the slide member 30 will move athwartships on the torpedo tube 10 as indicated by the arrow 50.

Figure 2:
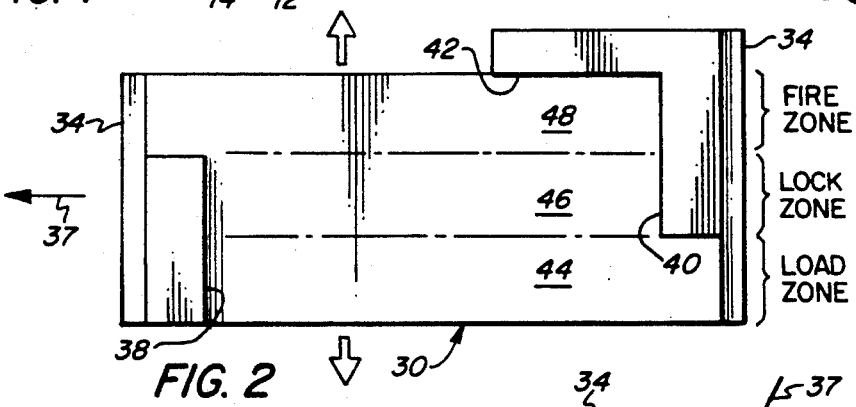
FIG. 2 is a bottom plan view of the slide member utilized in the positioning assembly of FIG. I.
Figure 3:
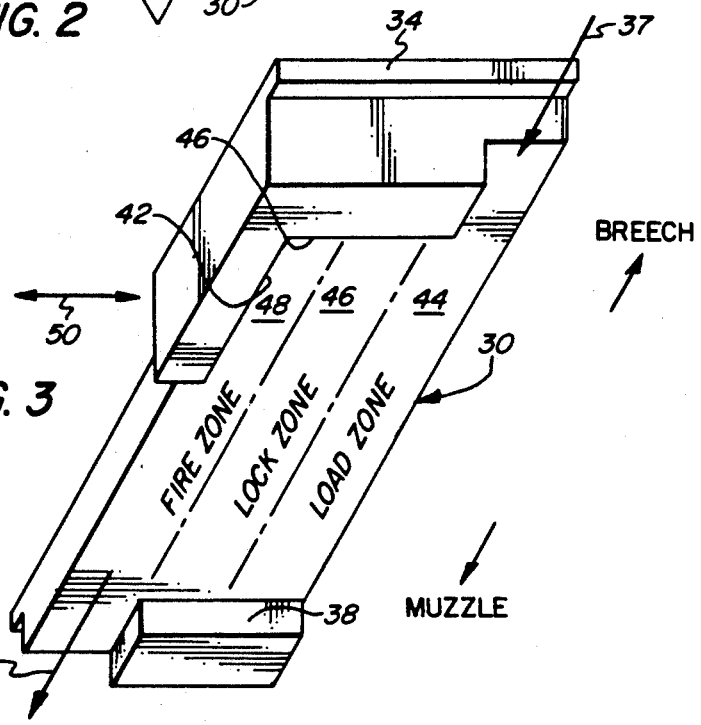
FIG. 3 is a perspective view of the slide member.

Turning next to FIGS. 2 and 3, the bottom surface of the slide member 30 has a series of abutment surfaces 38, 40 and 42 formed thereon. The first abutment surface 38 extends from on side along only a portion of the muzzle end of the slide member 30, and the abutment surface 40 extends from the other side of the slide member 30 and across only a portion of its breech end. The abutment surface 42 extends from the breech end along the other side of the slide member 30 for a limited portion of its length.

As mounted within the support member 18, the surfaces 38 and 40 are perpendicular to the plane of the paper as seen in FIG. 1, and represent abutment surfaces spaced axially over the length of the torpedo tube 10 and of the torpedo 12. The abutment surface 42 is disposed axially of the torpedo tube 10 and torpedo 12.

In the position seen in FIGS. 1 and 4, the slide member is oriented in its initial position with the piston rod 24 fully extended so that the load zone 44 is aligned with the guide stud 14. This allows the torpedo 12 to be loaded into the tube 10, and the guide stud 14 to be moved forward into the load zone 44 of the slide member 30. However, it cannot exit the load zone 44 because, if the guide stud 14 continued to move forwardly, it would stop against the abutment surface 38.

Figure 5:
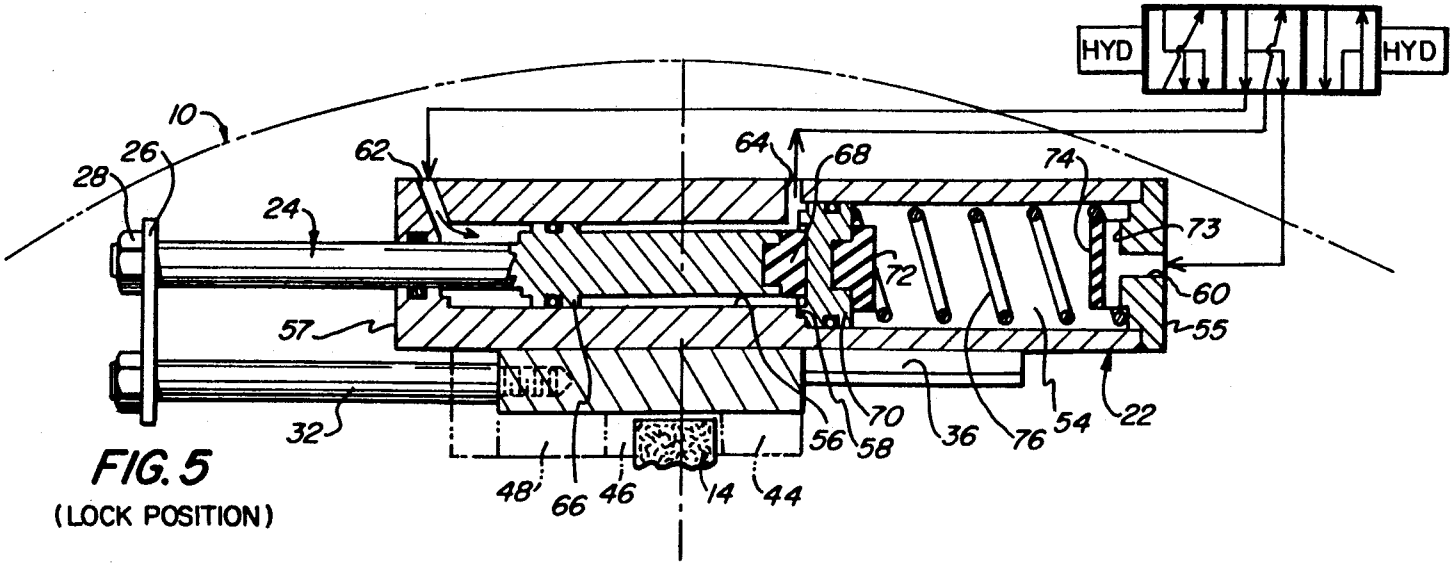
FIG. 5 is a similar view showing the elements of the positioning assembly in a second position for locking the torpedo against axial movement within the torpedo tube.

Following the loading of the torpedo 12 into the torpedo tube 10, the slide member 30 is moved athwartships into an intermediate position seen in FIG. 5 in which the guide stud 14 is disposed in the lock zone 46 between the first and second abutment surfaces 38 and 40. At this point, the guide stud 14 has only a limited rang of axial movement between these two surfaces and the force of water entering the torpedo tube 10 through the muzzle door (not shown) will permit the torpedo 12 to move rearwardly only until the guide stud 14 stops against the abutment surface 40.

Figure 6:
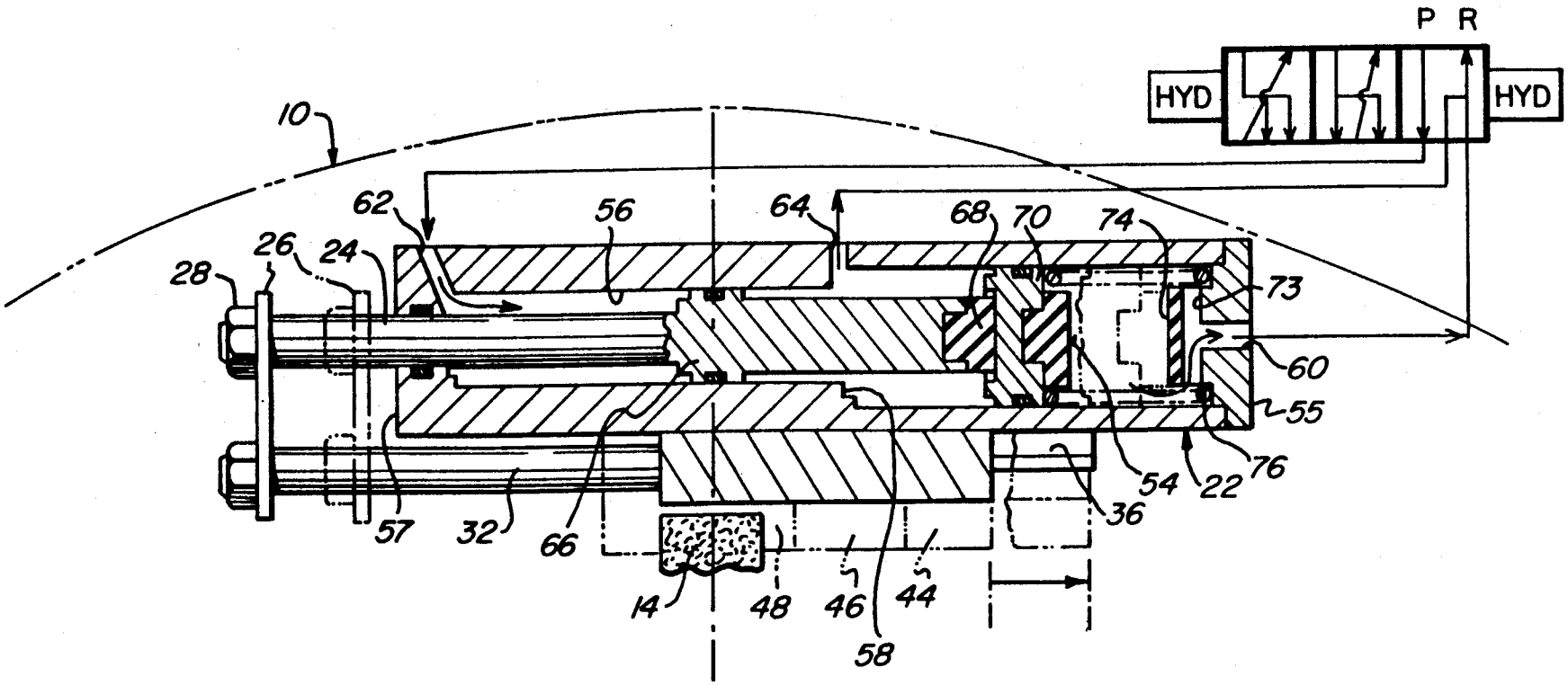
FIG. 6 is a similar view showing the elements of the positioning assembly in a third position permitting the torpedo to be fired from the torpedo tube.

When it is desired to fire the torpedo, the cylinder 22 is again actuated and moves the slide member 30 into a third position seen in FIG. 6 in which the guide stud 14 is now located in the fire zone 48. In this position, it cannot move rearwardly towards the breech by reason of the abutment of the guide stud 14 against the abutment surface 40. However, when the torpedo 12 is fired, it is free to move by the end of the abutment surface 38.

It will also be seen that the abutment of the abutment surface 42 against the guide stud 14 limits the amount of movement of the slide member 30 in the athwartships direction. Only after the guide stud 14 has moved clear of the abutment surface 42 can the slide member 30 continue its transverse motion so that it is completely clear of the aft guide stud (not shown) as the torpedo 12 moves forward to the muzzle door.

Turning now to FIGS. 4–6, the structure and operation of the cylinder 22 and piston rod 24 are therein illustrated.

As seen in the several figures, the cylinder 22 has a chamber with a smaller diameter portion 56 adjacent the end wall 57 through which the piston rod 24 extends, and a larger diameter portion 54 at its opposite end wall 55, and this forms a radially disposed shoulder 58 at the juncture therebetween. Extending through the end wall 55 of the larger diameter portion 54 is a port 60, and opening into the smaller diameter portion 56 adjacent the end wall 57 of the cylinder 22 is the port 62. A third port 64 opens into the smaller diameter portion 56 adjacent the shoulder 58.

As can be seen the piston rod 24 has a fixed piston 66 along its length, and it has a synthetic resin cushioning element 68 at its inner end. Slidably disposed within the larger diameter portion 54 is a movable piston 70 with a synthetic resin cushioning element 72 thereon. The end wall 55 of the piston cylinder 22 has an axially projecting boss 73 with a synthetic resin cushioning stop 74 thereon. A coil spring 76 is disposed within the larger diameter bore 54, and acts between the end wall 55 and the movable piston 70 to bias the movable piston 7 against the shoulder 58.

As seen in FIG. 4, when hydraulic fluid is pumped into the end port 60 and the port 64 adjacent the movable piston 70, this causes the piston rod 24 to move outwardly to its full length of travel. In this position, the slide member 30 is transversely disposed relative to the guide stud 14 so that the guide stud 14 is disposed in the load zone 44 of the slide member 30.

As seen in FIG. 5, when hydraulic fluid is introduced through the end ports 60 and 62, the piston rod 24 moves inwardly in the direction of the movable piston 70, but the movable piston 70 is held against the shoulder 58 by the hydraulic fluid entering through the port 60. This locates the slide member 30 so that the guide stud 14 is now disposed within the lock zone 46.

As seen in FIG. 6, when hydraulic fluid is introduced only through the end port 62 in the smaller diameter portion 56 of the cylinder, this moves the piston rod 24 axially against the movable piston 70 to compress the spring 76. This effects movement of the slide member 30 into the position in which the guide stud 14 is located in the fire zone. Although the hydraulic pressure would move the movable piston 70 and piston rod 24 until such time as the movable piston 70 abutted the stop 74, the guide stud 14 is in abutting engagement with the abutment surface 42 so that the slide member 30 cannot move past it. When the torpedo 12 is fired and moves axially forwardly within the torpedo tube 10 to a point where the stud 14 has passed beyond the end of the abutment surface 42, the piston rod 24 continues to move in the direction of the end wall 55 under the hydraulic pressure until the cushion member 72 abuts the stop 74 as seen in phantom line in FIG. 6.

As previously indicated, at this point the slide member 30 is displaced to one side of the guide channel (not shown) in the land 16 so that the aft guide stud (not shown) may move thereby without any interference.

Figure 7:
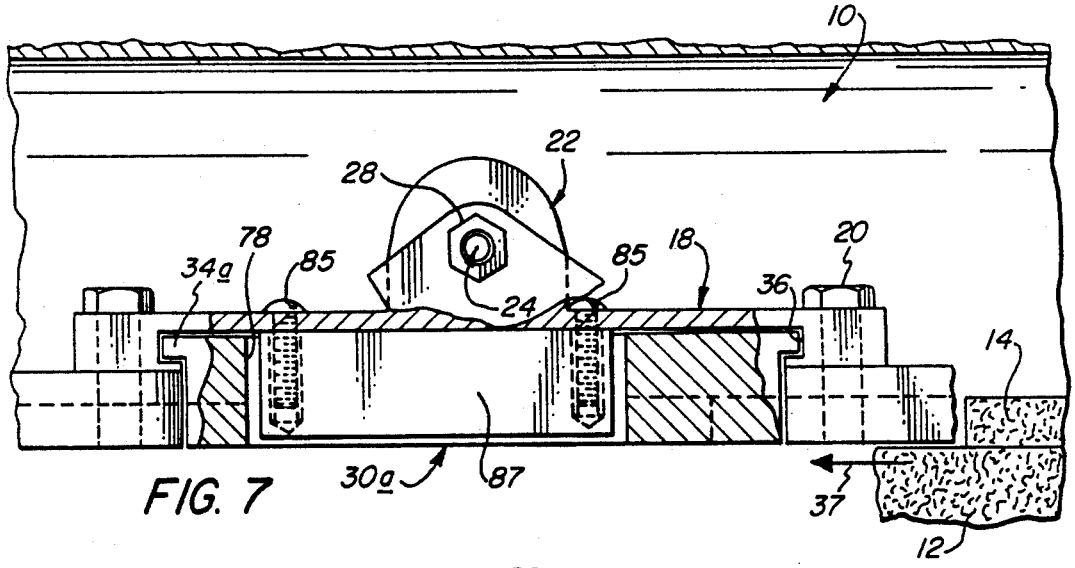
FIG. 7 is a view similar to FIG. 1 of another embodiment of positioning assembly utilizing a differently configured slide member.
Figure 8:
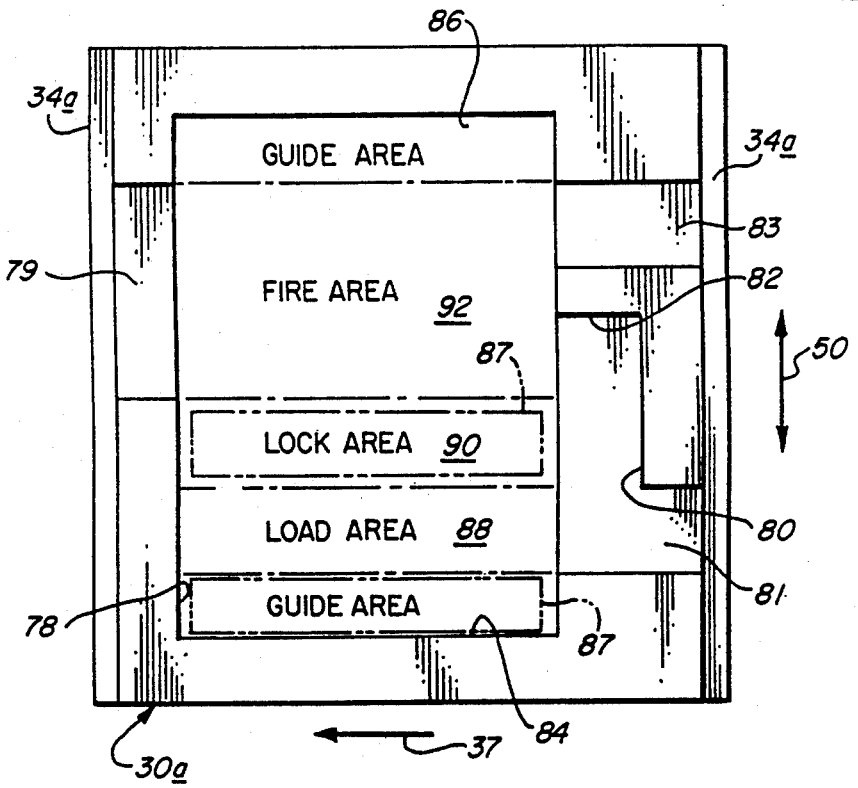
FIG. 8 is a bottom plan view of the slide member of FIG. 7.
Figure 9:
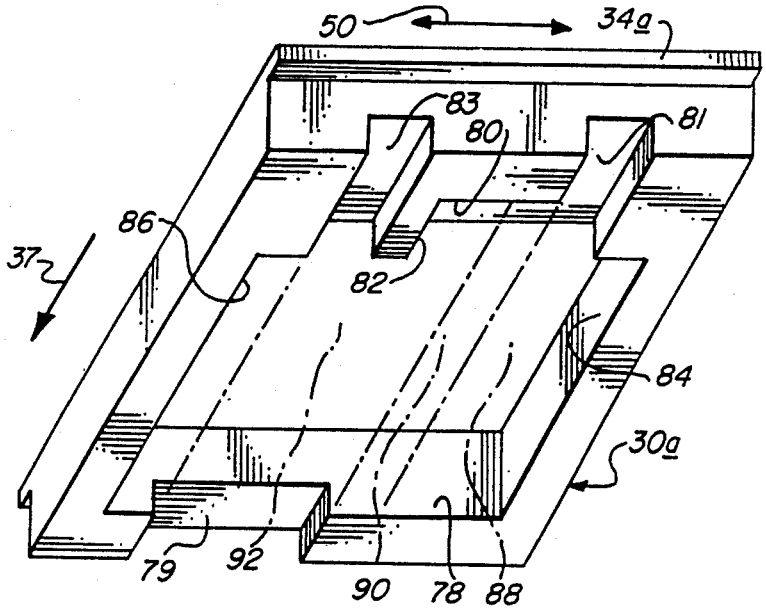
FIG. 9 is a perspective view of the slide member of FIGS. 7 and 8.

Turning now to the embodiment of FIGS. 7–9, the dimension of the slide member **30*a* is greater athwartships of transversely than that of the embodiment of FIGS. 1–6, and additional abutment or guide surfaces are provided. In this embodiment, the slide member 30*a* has an athwartships slot in its transverse wall through which extend a pair of athwartship guides 87 which are secured to the support member 18 by the fasteners 85. The guides 87 are closely spaced to provide a channel therebetween dimensioned to closely receive the guide stud 14 to prevent its rotation within the torpedo tube 10. To accommodate the guides 87 at either end of the athwartships motion of the slide member 30*a*, recesses 84 and 86 along the sides into which one will seat in the load and fire positions of the slide member 30*a*. Extending along the muzzle end of the slide member 30*a* from the recess 84, is an abutment surface 78 and this terminates in spaced relationship to the recess 86 so as to provide a passage 79 through the forward or muzzle end of the slide member 30*a*. Extending along the breech or inner end of the slide member 30*a* and commencing at a point spaced from the recess 84, is an abutment surface 80 which cooperates with a perpendicularly disposed abutment surface 82. As can be seen, the elements providing the abutment surfaces 80 and 82 are spaced intermediate the transverse dimension of the slide member 30*a* so that passages 81 and 83** are provided on either side thereof.

In this embodiment, the first passage 81 allows the torpedo 12 to be loaded into the torpedo tube 10 and the stud 14 to move into the load area 88 between the guides 87, as can be seen, one guide 87 is in the recess 84. Movement beyond the load area 88 is precluded by the abutment surface 78. After the torpedo 12 has been loaded and the stud 14 has moved into the load area 88, the piston cylinder 22 is actuated to move the slide member **30*a* transversely of the torpedo 12 and locate the guide stud 14 in the lock area 90. As can be seen, movement towards the muzzle end of the torpedo tube 10 is precluded by abutment of the stud 14 against the abutment surface 78, and movement aftward toward the breech door is precluded by abutment of the guide stud 14 against the abutment surface 80**.

When it is desired to prepare the torpedo 12 for firing, the cylinder 22 is actuated to move slide member **30*a* transversely and locate the guide stud 14 in the fire area 92 in which it will normally be abutting the abutment surface 82. One guide 87 is now disposed within the recess 86 and the other is located in alignment with the surface 82 to provide a clear passage. At such time as the torpedo 12 is fired and the guide stud 14 has passed beyond the end of the surface 82, the slide member 30*a* will be moved still further transversely to orient the passage 83 in alignment with the guide channel (not shown) in the land 16. If the torpedo 12 has an aft guide stud, it may then move through the passage 83 and outwardly through the passage 79**.

In this embodiment, if there is no aft guide stud in the guide channel of the land 16, it can be seen that the guides 87 prevent the guide stud 14 from rotational motion at all times.

Figure 10:
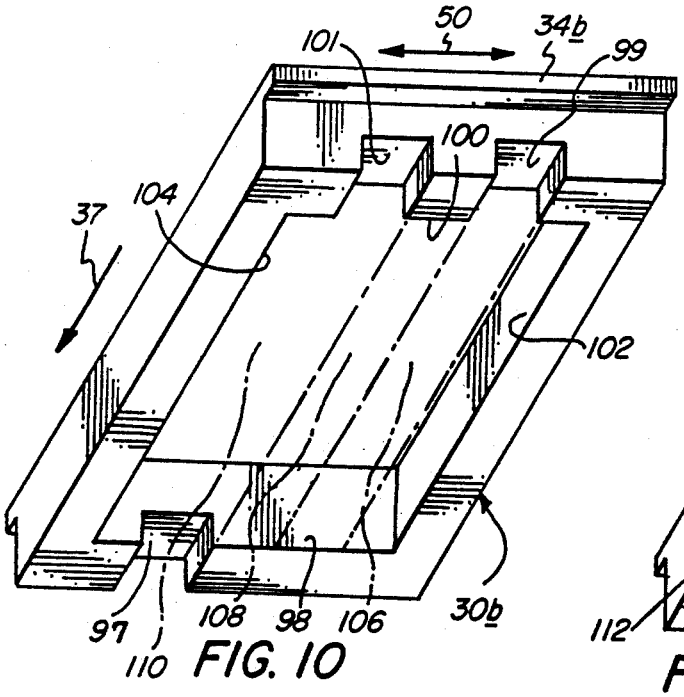
FIG. 10 is a perspective view of another embodiment of slide member which ma be utilized in the positioning assembly of the present invention.

In the embodiment of FIG. 10, the slide member **30*b* is also configured to provide a slot in its transverse wall through which similar guides (not shown) on the support 18 extend. It has side recesses 102 and 104 for a similar purpose, and the aft or breech end is provided with a pair of passages 99 and 101 with the abutment surface 100 located therebetween. The forward or muzzle end of the slide member 30***b* has an elongated abutment surface 98 with a passage 97 extending therethrough. When the torpedo 12 is loaded, the guide stud 14 passes into the slide member through the channel 99, and thus enters the load zone 106. After the torpedo 12 has been loaded, the slide member 30*b* is moved transversely to locate the guide stud 14 within the lock zone 108 between the abutment surfaces 100 and 98. When it is desired to effect firing of the torpedo, the slide member 30*b* is moved transversely to locate the guide stud 16 into the fire zone 110 in alignment with the passages 101 and 97. This embodiment can be utilized if there is no hydrodynamic force tending to move the weapon in a breechward direction.

Figure 11:
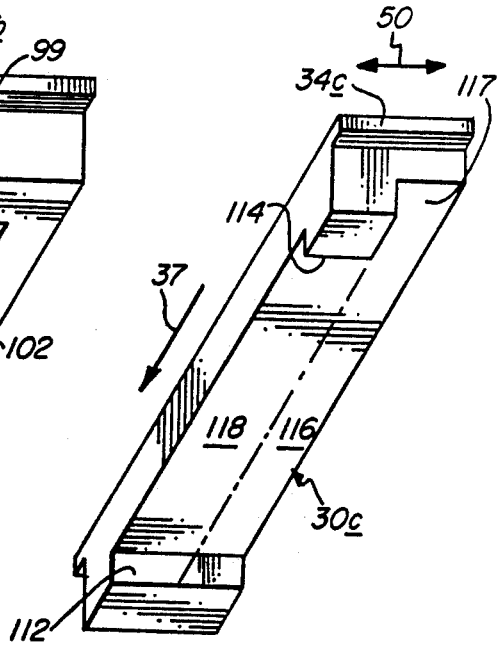
FIG. 11 is a perspective view of still another embodiment of slide member which may be used in the positioning assembly.

Turning lastly to the embodiment of FIG. 11, a relatively narrow slide member 30*c* is illustrated and it requires a piston cylinder with only a limited throw, and provides limited control against relative rotation of the torpedo 12 within the tube 10, or a firing area. This embodiment may be used if all torpedoes fired from the system have aft guide studs, and there is no hydrodynamic force tending to move the torpedo in a breechward 17 direction. In this embodiment, a relatively short abutment surface 114 is provided along the aft or breech end of the slide member 30*c* and this provides a channel 117 into the aft end of the slide member 30*c*. Extending across the full width of the muzzle end of the slide member 30*c* is an abutment surface 112. In this embodiment, the guide stud 14 enters through the channel 117 in the load area 116, and it is prevented from moving forwardly by abutment of the guide stud 14 against the abutment surface 112. After loading, the slide member 30*c* is moved transversely of the torpedo 12 to locate the guide stud 16 in the lock zone 118 between the abutment surfaces 114 and 112. When firing is desired, the slide member 30*c* is moved further transversely to move the slide member 30*c* out of the path of the guide stud 16 so that it and the aft guide stud (not shown) may pass freely thereby. In this embodiment, it will be noted that the aft guide stud prevents possible relative rotational motion of the torpedo 12 relative to the slide member 30*c*.

As it can be seen in each of the illustrated embodiments, the guide stud is allow to freely enter into the slide member which is thereafter moved transversely into a position wherein the guide stud is trapped between forward and aft abutment surfaces to prevent its movement in either direction. When firing of the torpedo is intended, the slide member is moved into still another position in which the guide stud is moved into a position wherein it is clear of the forward abutment surface so that it can move outwardly in the torpedo tube. When a second guide stud is not provided, fixed guides must be included on the support member to limit any tendency for the torpedo to rotate within the tube.

The slide member may be fabricated by assembling blocks to a base plate to provide the abutment surfaces, or by milling or machining a solid block of metal, or by producing the slide member as a casting. The support member is conveniently formed by machining, cutting, and assembling metal plates to provide the slide channels for the slide member and a mounting for the cylinder 22. The connector plate is conveniently fabricated by cutting the desired shape from a piece of sheet metal stock. The several elements may be readily assembled in a secure fashion, and the entire positioning assembly may be mounted on a section of the top land approximating the position of the forward guide stud when the torpedo is loaded in the tube.

Although a hydraulic cylinder assembly has been described, a pneumatic cylinder or a mechanical gear system may be employed to move the slide member. Desirably, the hydraulic or pneumatic valve and pump components utilized to actuate the cylinder and piston rod are located within the interior of the submarine and only the conduits to the ports of the cylinder disposed externally of or within the torpedo tube. This allows more convenient maintenance of the valves and pumps.

Thus, the positioning assembly of the present invention may be used both with torpedoes having a pair of axially spaced guide studs or torpedoes having a single guide stud, or with torpedoes having other projecting elements along the axial length. Bumpers and dashpots are conveniently provided within the cylinder so as to reduce the amount of noise during operation. Although the assembly has been shown as mounted on the top land within the torpedo tube, it may also be supported upon the torpedo tube itself.

Thus, it can be seen from the foregoing detailed description and drawings that the positioning assembly of the present invention provides positive control for limiting axial movement of the torpedo within the torpedo tube. The components may be fabricated relatively easily and assembled to provide a relatively long lived structure. The slide member is movable between selected positions transversely of the torpedo center line by a hydraulic or pneumatic cylinder which enables relatively trouble free and reliable motion.

In light of the above, it is therefore understood that within the scope of the appended claims, the invention may be practiced otherwise than as specifically described.

What is claimed is:

1. In combination with a torpedo tube having breech and muzzle ends and a torpedo having at least one outwardly extending projection intermediate its length for guidance thereof during axial movement along said tube., a positioning assembly comprising:

a support mounted on said torpedo tube adjacent said projection;

a control member movable on said support transversely of said torpedo tube and having a control surface with a series of abutments for said projection on said torpedo and thereby limiting motion of said torpedo within said tube, said control surface being configured to provide a first transverse abutment surface to limit movement of said torpedo towards said muzzle end of said tube during loading thereinto and a second transverse abutment surface axially spaced from and cooperating with a portion of said first abutment surface to limit movement of said torpedo in either direction axially in said tube, said control member being movable on said support to (i) a first position wherein said projection is engageable with only said first abutment surface, (ii) a second position wherein said projection is disposed between said first and second abutment surfaces, and (iii) a third position wherein said projection is free from said first abutment surface so that said torpedo is movable towards said muzzle end of said tube; and drive means for moving said control member to said several positions.

2. The positioning assembly in accordance with claim 1 wherein said control member includes a third, axially disposed abutment surface along the side of said control member spaced from said first abutment surface and adjacent said second abutment surface, said first abutment surface terminating in spaced relationship from said side to permit said projection to move outwardly of said control member towards said muzzle end and beyond in said third position, said third abutment surface limiting motion of said control member into a fourth position wherein it is displaced from the axial path of travel of said projection by abutment against said projection until said projection has moved towards the muzzle end of said tube and beyond said third abutment surface.

3. The positioning assembly in accordance with claim 1 wherein said positioning assembly includes axially disposed abutment surfaces to limit rotational movement of said torpedo in either direction in said tube while said projection is disposed therebetween.

4. The positioning assembly in accordance with claim 1 wherein said control member is slidably supported on said support member and said drive means moves said control member transversely of said torpedo tube.

5. The positioning assembly in accordance with claim 1 wherein said drive means includes a cylinder and a piston rod extending outwardly therefrom and operatively coupled to said control member the outwardly extending portion of said piston rod being movable between predetermined positions to effect the desired motion of said control member.

6. The positioning assembly in accordance with claim 5 wherein said cylinder and piston rod are oriented transversely of said tube and wherein said drive means moves said control member transversely of said torpedo tube.

7. The positioning assembly in accordance with claim wherein said cylinder has a chamber with a smaller diameter portion adjacent the end through which said piston rod extends and a larger diameter portion adjacent the other end providing a shoulder therebetween, wherein said piston rod has a fixed piston thereon in sealing engagement with the wall defining said smaller diameter portion, and wherein there are included (i) a movable piston in said larger diameter portion in sealing engagement with the wall thereof, (ii) resiliently compressible biasing means biasing said movable piston against said shoulder, (iii) ports in said cylinder into said chamber adjacent each end thereof and in said smaller diameter portion adjacent said shoulder, whereby (a) fluid under pressure introduced through said ports in the end of said larger diameter portion and adjacent said shoulder will move said piston rod to a fully outwardly extended position, (b) fluid under pressure introduced through said ports at each end of said chamber will move said piston rod to an intermediate position in which the inner end thereof abuts the movable piston, and (c) fluid under pressure supplied only to the port adjacent the end of said smaller diameter portion will move said piston rod to a retracted position in which it moves said movable piston away from the shoulder against said biasing means and towards said other end of said cylinder.

8. The positioning assembly in accordance with claim 1 wherein said projection on said torpedo is a guide stud.

9. In combination with a torpedo tube having a breech and muzzle ends and a torpedo having a pair of axially spaced radially projecting guide studs intermediate its length, a positioning assembly for controlling the movement of said torpedo along said tube, said positioning assembly including:

a support mounted on said torpedo tube adjacent the forward one of said torpedo guide studs;

a slide member slidably movable on said support transversely of said torpedo tube and having a control surface with a series of abutment surfaces for said forward guide stud to provide abutment surfaces limiting movement of said stud thereabout including a first transverse abutment surface limiting axial movement of said torpedo towards said muzzle end of said tube during loading thereinto, an axially spaced second transverse abutment surface cooperating with said first abutment surface to limit axial movement of said torpedo in either direction axially in said tube, and an axial abutment surface adjacent the aft end of said control member adapted to abut said guide stud to limit movement of said slide member until said guide stud has moved in said tube therebeyond towards said muzzle, said several slide member abutment surfaces being operatively alignable with said forward torpedo stud by movement of said slide member on said support between predetermined positions, said control member being movable on said support to (i) a first position wherein said projection is engageable with only said first abutment surface, (ii) a second position wherein said projection is disposed between said first and second abutment surfaces, and (iii) a third position wherein said projection is free from said first abutment surface so that said torpedo is movable towards said muzzle end of said tube, but initially abuts said axial abutment surface to limit motion of said slide member; and drive means for moving said slide member between said predetermined positions.

10. The positioning assembly in accordance with claim 9 wherein said first abutment surface is provided by a transversely extending wall adjacent the forward end of said slide member and extending transversely from adjacent one side of said slide member but terminating inwardly from the other side of said slide member, and the second abutment surface is provided by a second transversely extending wall extending adjacent the rearward end of said slide member from adjacent said other side thereof but terminating inwardly from said one side thereof, and said axial abutment surface is provided by a wall extending along only a portion of the axial length of said other side of said slide member and adjacent the rearward end thereof.

11. The positioning assembly in accordance with claim 10 wherein said positioning assembly includes axially disposed abutment surfaces to limit rotation of said torpedo in either direction in said tube.

12. The positioning assembly in accordance with claim 9 wherein said drive means moves said slide member transversely of said torpedo tube.

13. The positioning assembly in accordance with claim 9 wherein said drive means includes a cylinder and a piston rod extending outwardly therefrom and operatively coupled to said slide member, the outwardly extending portion of said piston rod being movable between predetermined positions to effect the desired motion of said slide member.

14. The positioning assembly in accordance with claim 13 wherein said cylinder and piston are oriented transversely of said tube and wherein said drive means moves said slide member transversely of said torpedo tube.

15. The positioning assembly in accordance with claim 14 wherein said cylinder has a chamber with a smaller diameter portion adjacent the end through which said piston rod extends and a larger diameter portion adjacent the other end providing a shoulder therebetween, wherein said piston rod has a fixed piston thereon in sealing engagement with the wall defining said smaller diameter portion, and wherein there are included (i) a movable piston in said larger diameter portion in sealing engagement with the wall thereof, (ii) resiliently compressible biasing means biasing said movable piston against said shoulder, (iii) ports in said cylinder into said chamber adjacent each end thereof and in said smaller diameter portion adjacent said shoulder, whereby (a) fluid under pressure introduced through said ports in the end of said larger diameter portion and adjacent said shoulder will move said piston rod to a fully outwardly extended position, (b) fluid under pressure introduced through said ports at each end of said chamber will move said piston rod to an intermediate position in which the inner end thereof abuts the movable piston, and (c) fluid under pressure supplied only to the port adjacent the end of said smaller diameter portion will move said piston rod to a retracted position in which it moves said movable piston away from the shoulder against said biasing means and towards said other end of said cylinder.

* * * * *